US005816858A

United States Patent [19]

Kazarian et al.

[11] Patent Number: 5,816,858

[45] Date of Patent: Oct. 6, 1998

[54] FUSE HOLDER WITH COVER

[75] Inventors: David Michael Kazarian, Canton; Akiyoshi Sato, West Bloomfield, both of Mich.

[73] Assignee: Yazaki Corporation, Tokyo, Japan

[21] Appl. No.: 631,145

[22] Filed: Apr. 15, 1996

[51] Int. Cl.[6] ..... H01R 13/69

[52] U.S. Cl. ..... 439/621; 439/366

[58] Field of Search ..... 439/621, 622, 439/447, 366

[56] References Cited

U.S. PATENT DOCUMENTS

| | | | |
|---|---|---|---|
| 4,227,761 | 10/1980 | Cairns et al. . | |
| 5,145,414 | 9/1992 | Oikawa | 439/621 |
| 5,171,293 | 12/1992 | Umemoto et al. | 439/622 |
| 5,277,626 | 1/1994 | Oikawa et al. | 439/621 |
| 5,444,428 | 8/1995 | Carr et al. | 439/622 |

*Primary Examiner*—Khiem Nguyen
*Assistant Examiner*—Eugene G. Byrd
*Attorney, Agent, or Firm*—Young & Basile, P.C.

[57] ABSTRACT

A fuse holder for securely retaining a fuse in a captive, pre-set position relative to a fuse box when the fuse is temporarily removed from electrical connection with a fuse receptacle of the fuse box, the pre-set position keeping the fuse readily available for reinsertion into the fuse receptacle. The fuse holder has a cover that when closed prevents removal of the fuse from the top side of the holder and when open permits removal of the fuse. The fuse holder further has fuse retaining nubs that permit the fuse to be inserted into the holder from below, this feature making the holder compatible with automated assembly of the fuse box.

11 Claims, 2 Drawing Sheets

FUSE HOLDER WITH COVER

FIELD OF THE INVENTION

The present invention relates generally to an automotive vehicle fuse box, and more particularly to a fuse holder for maintaining a fuse in captive association with the fuse box such that the fuse is movable between an inserted position wherein the fuse is electrically connected into a desired circuit and a pre-set position wherein the fuse is not electrically connected but is nevertheless mechanically retained in a position from which it is easily returned to the connected position.

BACKGROUND OF THE INVENTION

Fuses are commonly used in automotive electrical systems to protect circuits against potential damage caused by overload conditions. Fuses for various circuits are often gathered together at a single location, known variously as a fuse box, a power distribution block, or a junction block. A fuse box is typically a molded plastic structure containing electrical terminals and one or more bus bars, and the fuses are retained in terminal sockets integrally molded on the exterior surface of the fuse box. A typical automotive fuse has a generally rectangular plastic body with a pair of bayonet-like contacts extending from one end, and when the fuse is fully inserted into its respective terminal socket the contacts engage electrical terminals inside of the fuse box to complete a circuit.

It is sometimes desirable to temporarily remove certain fuses from their associated circuits to perform maintenance or simply to prevent battery drain. Clock circuits, for example, are connected directly to the vehicle battery with no intervening switches, so they draw current from the battery continually. When a vehicle is being shipped or stored for long periods of time without the engine being run occasionally to recharge the battery, this may eventually drain the battery. Other vehicle electrical systems should be disabled during certain maintenance or service functions to prevent damage to the systems and/or injury to the person working on the system. It is good practice, for example, to disable the circuits related to the air bag system before working on any system or circuit located near the air bags in order to lessen the likelihood of unintentional activation of the air bags.

Since fuses are easily lost once removed from the fuse box, attempts have been made to retain fuses in physical association with the box even when disconnected electrically. U.S. Pat. No. 5,145,414 discloses a fuse box wherein guide walls are formed integrally with either the fuse box itself or with a cover for the box. The guide walls surround a terminal socket to form a channel, and the fuse slides up into the channel when removed from its connected position. Retaining means are formed on the guide walls and extend into the channel to engage the fuse and maintain it in the raised, disconnected position and to prevent it from falling out the end of the channel. This structure is a relatively complex addition to a standard fuse box design, and so increases the cost of the box. Also, insertion of a fuse into the channel can not be done by the automated process used to insert fuses into the other terminal sockets, but rather must be done manually in a separate assembly step.

U.S. Pat. No. 5,171,293 discloses a fuse box assembly having a fuse holder that extends across the opening of a terminal socket and is connected to the fuse box in a manner to allow it to move toward and away from the terminal socket. When in the inserted position in its terminal socket, a fuse extends through an opening in the fuse holder, the opening being sized so that it will pass the main body of the fuse but will not pass a flanged head of the fuse. The fuse holder is pulled away from the terminal socket to lift the fuse out of its inserted position and hold it in a pre-set position immediately above the terminal socket. To return the fuse to its inserted position the fuse is pressed toward the terminal socket, forcing the fuse holder back to its original position. When in the pre-set position, the fuse is retained in the fuse holder only by frictional engagement between the sides of the fuse and a plurality of nubs extending from the fuse holder into the aperture.

This has been found to be an unreliable means of keeping the fuse in the holder; i.e., the fuse may fall out due to inadvertent contact, vibration, or other causes.

Also, when attempting to return the fuse to the inserted position from the pre-set position it is possible to unintentionally press down on the holder rather than the fuse itself. If this occurs, the snug interference fit between the fuse bayonets and their mating terminals within the sockets may force the fuse up and out of the holder as the holder moves toward the terminal socket. If this happens, the bayonets are not inserted fully into the terminals, and proper electrical connection with its circuit is not achieved. This prior art fuse holder design also requires use of a manual assembly process rather than the automated process used to insert the fuses in the terminal socket that do not feature fuse holders.

SUMMARY OF THE INVENTION

An objective of the present invention is to provide an improved mechanism for securely retaining a fuse in a captive, pre-set position relative to a fuse box when the fuse is temporarily removed from electrical connection with a terminal socket, the pre-set position keeping the fuse readily available for reinsertion into the terminal socket. A further objective of the present invention is to provide such a fuse retention means that is compatible with automated assembly of the fuse box.

In general, these objectives are achieved by the use of a fuse holder which is essentially fixedly attached to the associated fuse, but is movably attached to the fuse box to permit the fuse to be withdrawn from a first, electrically connected position and held in a second, nonconnected position where it can be readily and conveniently restored to the connected position by a simple manipulation when the manufacturer, shipper, serviceperson, owner or other appropriate person is ready to reactivate the electrical circuit associated with the fuse.

As will be apparent from a reading of the following specification, the term "fixedly attached," as used herein to describe the association between the fuse holder and the fuse, is intended in a relative sense; i.e., the two elements need not be permanently attached but are associated in such a way that movements of the fuse and holder relative to the fuse box are necessarily simultaneous.

The fuses disclosed herein for purposes of illustration are the currently conventional automotive fuses, such as the LF™ "mini" fuse, having a pair of bayonet-type connectors projecting in parallel from a molded plastic body which has channels formed on opposite faces in parallel alignment with the bayonets. The fuses are typically marked on an end opposite the bayonets with the amperage rating of the fuse.

According to the invention, the fuse box has terminal sockets for receiving the connectors of the fuses, and the fuse holder comprises a frame defining a hollow interior volume with an open lower side of the body oriented toward the fuse box and an open upper side. The frame is configured to receive a fuse in an essentially fixed position relative to the fuse holder, and the fuse holder is mounted on the fuse box for movement between a first position wherein the connectors of the fuse are inserted into electrical connection with the associated terminal socket and a second position wherein the connectors are disconnected from the associated terminal socket. The fuse holder further comprises a cover connected to the body and movable between a closed position wherein the cover blocks movement of the fuse out of the fixed position with respect to the fuse holder toward the second side of the body and an open position wherein the cover does not significantly block movement of the fuse toward the second side of the body. The cover positively retains the fuse in its fixed position within the opening of the fuse holder when the fuse holder is in the second, disconnected position, preventing the fuse from being unintentionally dislodged from the fuse holder by vibration or other forces.

In an illustrative embodiment of the invention described herein, the cover is connected to the body by a living hinge and features latch means that engage mating latch means on the body to secure the cover in the closed position. The mated latch means may be easily disengaged to allow the cover to be opened when it is necessary to remove the fuse from the holder, for example to replace a blown fuse. The cover further includes a window formed therein and positioned to allow viewing of the fuse when the fuse is retained in the holder and the cover is in the closed position. The window thus permits the fuse rating markings on the fuse to be read even when the cover is closed.

According to a further feature of the invention, at least one retainer nub is disposed on the body and extends into the opening. The nub has a ramp surface inclined with respect to the axis between the first and second sides of the body, the ramp surface allowing the fuse to pass through the opening into the fixed position from the first side of the body. The nub further has a stop surface which engages a cooperating surface on the fuse when the fuse is in the fixed position to substantially prevent movement of the fuse toward the first side of the body. This configuration of the nub allows the use of an automated fuse box assembly process wherein a fuse is first inserted into its connected position in its respective terminal socket, and a fuse holder is then pressed down over the fuse so that the fuse snaps through the opening and into the fixed position within the fuse holder.

In the illustrative embodiment of the invention described herein, the fuse holder is intended for use with standard automotive fuses of the type having a main body from which a pair of parallel, bayonet-type connectors extend, the body further having a pair of channels formed in each of first and second sides and extending parallel with the connectors. The opening in the body of the fuse holder is dimensioned to receive such a fuse, and four retainer tabs extend from the body into the opening to engage each of the four channels.

DETAILED DESCRIPTION OF THE PREFERRED EMBODIMENT

The invention fuse holder 10 shown is intended for use with a fuse box 12 and a fuse 14 as shown in FIGS. 1–7.

Fuse 14 is of the type including a main body 14*a*, a pair of bayonet-type connectors 14*b* extending downwardly from a lower end of the body, and channels 14*c* formed on each side of the fuse and extending parallel with the bayonet connectors. Channels 14*c* are open at their lower ends adjacent connectors 14*b* and terminate in end walls 14*d* adjacent a top end of the fuse body (best seen in FIGS. 5 and 6), and provide points at which the fuse may be gripped by a fuse removal tool (not shown) as is known in the art.

Fuse body 14*a* is formed of a suitable moldable dielectric material and connectors 14*b* are formed of a suitable conductive material and are electrically connected within body 14*a*, in a known manner, by a fusible link. Fuse 14 is marked on the top end with numerals 16 indicating the amperage rating of the fuse.

Figure 1:
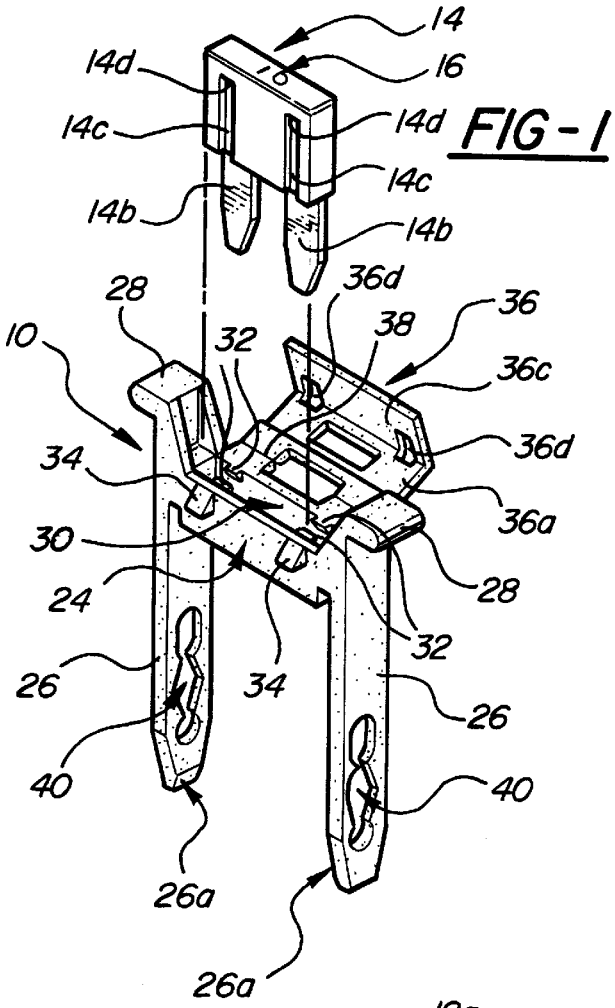
FIG. 1 is a perspective view of a fuse holder according to the present invention with a cover in an open position and a fuse.
Figure 2:
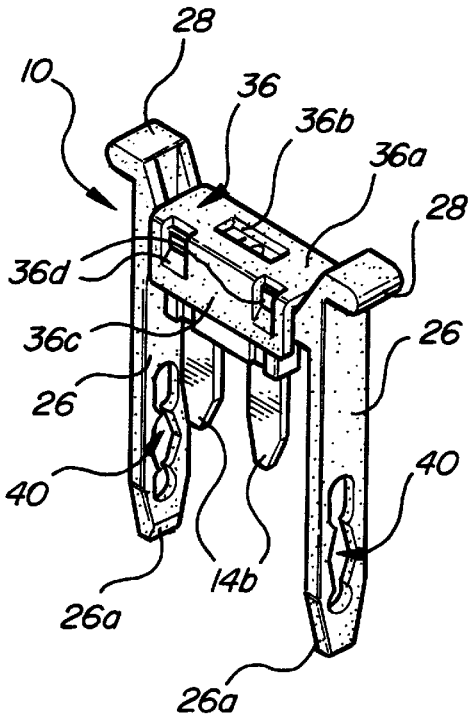
FIG. 2 is a perspective view of a fuse holder FIG. 1 with a fuse operatively positioned therein and the cover closed.
Figure 3:
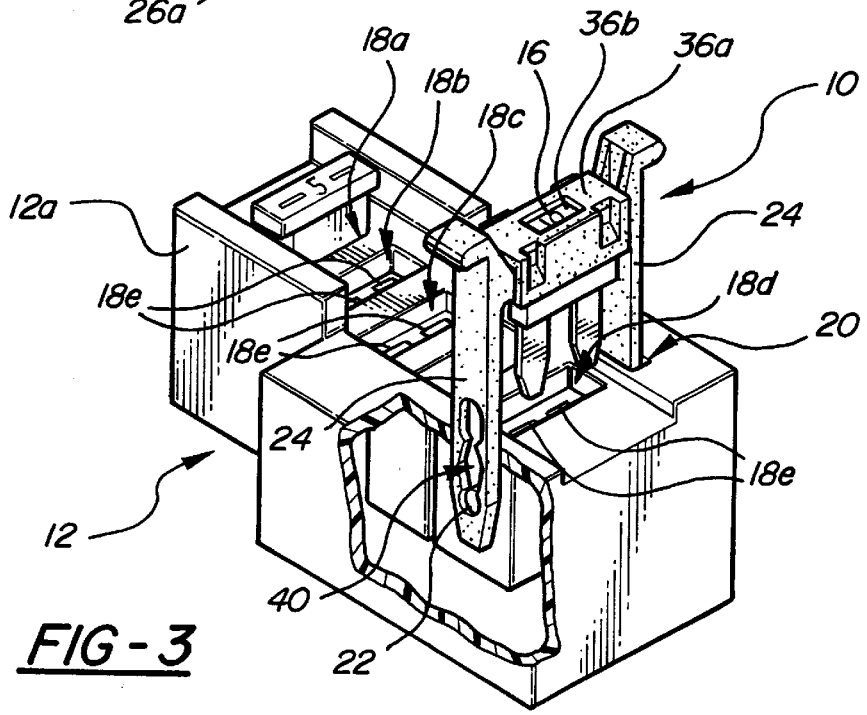
FIG. 3 is a perspective view of the invention fuse holder in combination with a fuse box showing the fuse older in a pre-set position.
Figure 4:
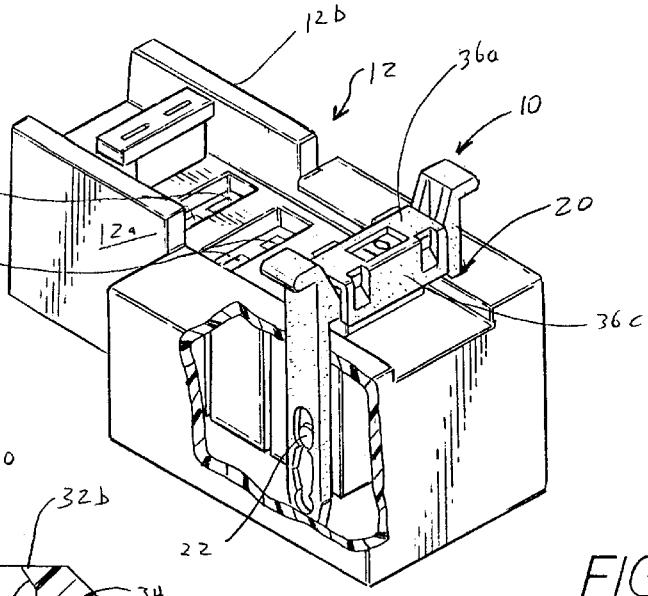
FIG. 4 is a perspective view of the invention use holder in combination with a fuse box showing the fuse holder in an inserted position.

Fuse box 12 as shown in FIGS. 3 and 4 is formed of a plastic or other moldable dielectric material and has parallel side walls 12*a* and 12*b*. A plurality of upwardly opening female fuse receptacles 18*a, b, c* and *d* are provided in serial relation on the upper surface of the fuse box. Side walls 12*a,* 12*b* are of reduced height adjacent socket 18*d,* and are wider and of double-wall construction. A pair of guide slots 20 are formed integrally with the upper edge of side walls 12*a*, 12*b* on opposite sides of socket 18*d,* the slots extending vertically downward into the side walls, and a pin 22 of circular cross section is formed integrally with each side wall on the inside of each guide slot and projecting outwardly therefrom.

Each fuse receptacle 18*a*, 18*b*, 18*c*, 18*d* includes, in known manner, a pair of connector slots 18*e* for receiving the connectors 14*b* of a fuse 14. A fuse box having generally the same configuration is disclosed in U.S. Pat. No. 5,171,293, the disclosure of which is incorporated herein by reference.

Fuse holder 10 is formed from a plastic or other dielectric material and is generally H-shaped, comprising a frame 24, two mounting legs 26 extending in parallel downwardly from opposite ends of the frame, and two grip tabs 28 extending upwardly from the frame. Grip tabs 28 turn outwardly adjacent their upper ends.

Figure 7:
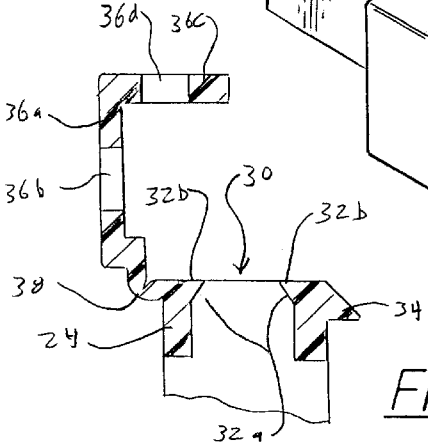
FIG. 7 is a detail cross-sectional view of the upper portion of the fuse holder.
Figure 5:
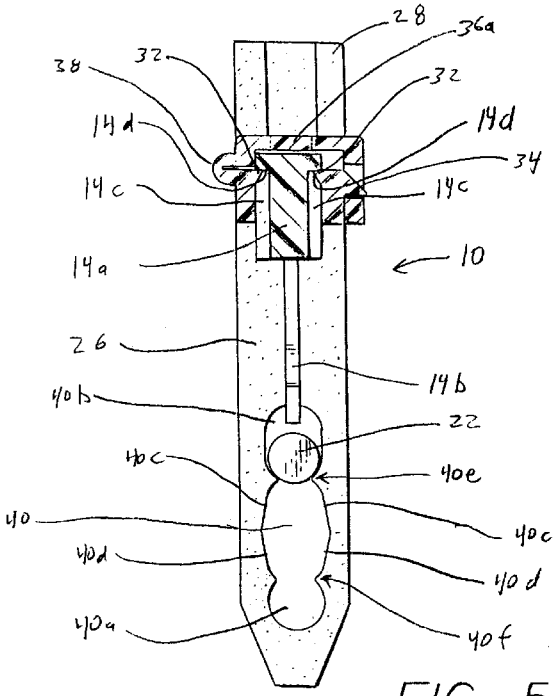
FIG. 5 is a vertical cross-section through the fuse holder in the inserted position of FIG. 4.

Frame 24 is of generally rectangular shape and defines a rectangular interior volume open at both its upper and lower sides, and of a shape and size generally corresponding to the cross-sectional configuration of fuse body 14*a*. Four retaining tubs 32 are formed on the inner walls of frame 24, two nubs being located on each inner wall an d projecting into the interior of the frame. Retaining nubs 32 are wedge-shaped, having ramp surfaces 32*a* that are inclined inwardly with respect to the frame inner walls and stop surfaces 32*b* located adjacent the upper side of the frame and oriented substantially perpendicular to the frame inner walls. As best seen in FIG. 7, the distance between the nubs on opposing sides of the frame thus tapers gradually from the full width of the interior of the frame at the bottom of the nubs to a reduced distance at the top of the frame. A pair of latch projections 34 are also formed integrally with frame 24, extending outwardly from an exterior wall of the frame.

Figure 6:
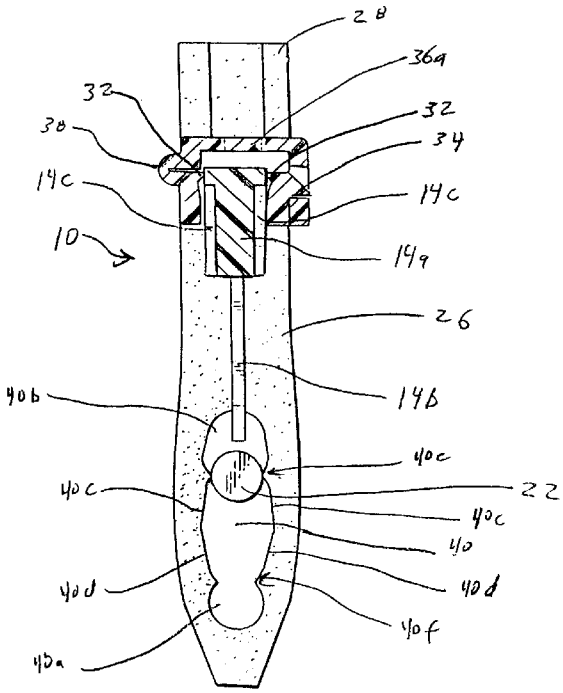
FIG. 6 is a vertical cross-section through the fuse holder as it is urged into engagement with the fuse box and fuse.
Figure 4:
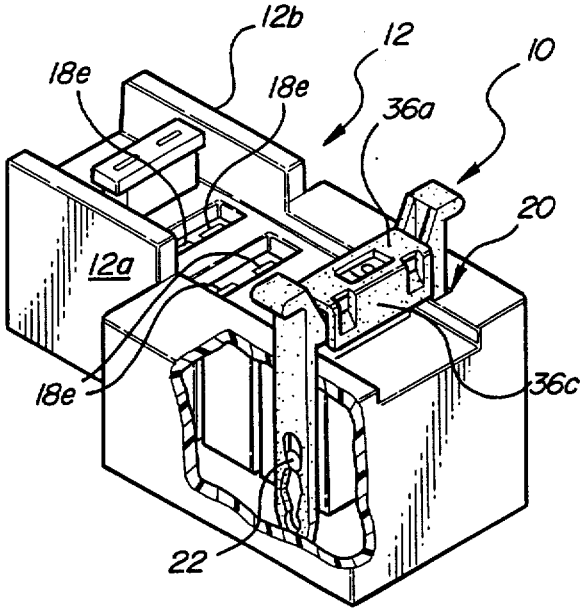
Figure 7:
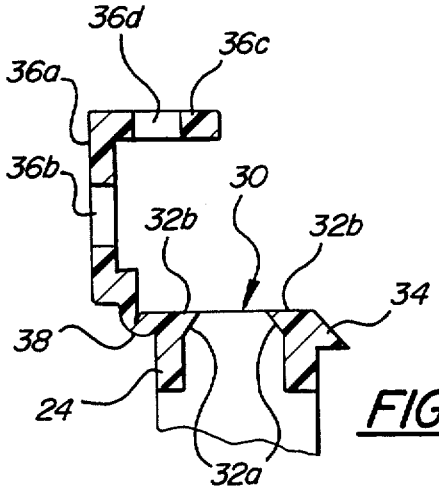
Figure 5:
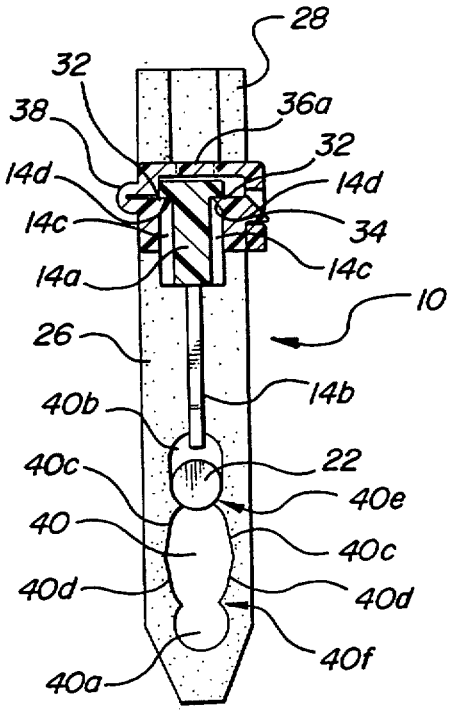
Figure 6:
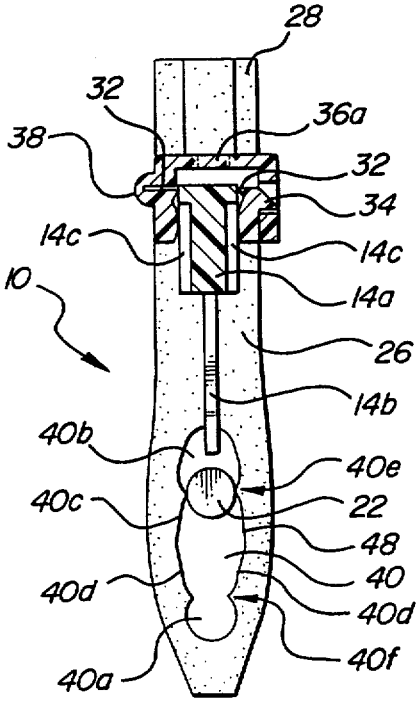

Frame 24 is sized to slidably pass the body of fuse 14 when the fuse is inserted into the frame with connectors 14*b* entering the opening first. Retaining nubs 32 are located so that they project into engagement with channels 14*c* formed in fuse body 14*a*. When fuse 14 is fully inserted into frame 24, stop surfaces 32*b* of retaining nubs 32 contact end walls 14*d* of channels 14*c* to prevent fuse 14 from passing completely through the frame in the downward direction. The inward taper of the distance between the nubs on opposing sides of the frame allows fuse 14 to be urged into the frame from below, with the top of the fuse contacting ramp surfaces 32*a* and this contact forcing the nubs apart as seen in FIG. 6.

A cover 36 is molded integrally with frame 24 and is connected thereto by a living hinge 38 extending along the edge of the frame which lies opposite latch projections 34. Cover 36 comprises a top wall 36*a* having a window 36*b* formed therein and a latch wall 36*c* extending substantially perpendicularly to the top wall. Two latch apertures 36*d* are formed in latch wall 36*c* and are spaced so as to coincide with the spacing between latch projections 34 on frame 24.

A vertical slot 40 is provided in each mounting leg 26 of the holder. Each slot includes a lower circular portion 40*a* having a diameter slightly exceeding the diameter of pins 22, an upper oval portion 40*b* having a width slightly exceeding the diameter of pins 22, and a central portion defined by upper and lower pairs of straight edges 40*c*, 40*d* respectively. Upper straight edges 40*c* converge slightly at their upper ends and connect with oval portion 40*b* to form an upper neck area 40*e*, and lower straight edges 40*d* converge slightly at their lower ends and connect with circular, portion 40*a* to form a lower neck area 40*f*, with each neck area having a width slightly smaller than the diameter of pins 22 so that a pin may detentingly pass therethrough. The extreme lower ends of mounting legs 26 are formed with an inwardly sloped bevel 26*a*.

When fuse 14 is retained in its fixed position within fuse holder 10 with cover 36 closed as in FIGS. 25, the top surface of the fuse is visible through window 36*b* so that numerals 16 on the fuse may be read.

In the assembled relation of fuse holder 10 and fuse box 12, mounting legs 26 extend downwardly into guide slots 20 with pins 22 respectively received in slots 40. It will be seen that holder 10 is mounted for displacement relative to fuse box 12 between a lowered, fuse-operative position seen in FIG. 4, and a raised, fuse-inoperative position seen in FIG. 3.

In the lowered position seen in FIG. 4, fuse connectors 14*b* are inserted into their respective connector slots 18*e* so as to establish electrical communication through the fuse and complete the electrical circuit associated with fuse receptacle 18*d*. Pins 22 are seated in respective oval portions 40*b* of slots 40, and any inadvertent movement of fuse holder 10 upward is resisted by the interference between the pins and the narrowing sides of the slots at neck area 40*e*.

Holder 10 is moved to the raised position seen in FIG. 3 by lifting upwardly on grip tabs 28. In the raised position, connectors 14*b* are withdrawn from their respective connector slots 18*e* to break the circuit associated therewith, and the fuse is held in a pre-set position above fuse receptacle 18*d*. As the holder is moved upwardly to the pre-set position, mounting legs 26 move slidingly in guide slots 20 and pins 22 move out of oval portions 40*b* by passing through respective neck areas 40*e* with a snapping detent action, and subsequently into circular portions 40*a* through respective neck areas 40*f* with a snapping detent action. When pin 22 is in circular portions 40*a*, the detent effect of necks 40*f* positively maintain the holder in the pre-set position and inhibit inadvertent movement of the holder to its lowered position. When it is desired to move the holder back to its operative position, the holder is simply pressed downwardly to pass pins 22 upwardly through neck areas 40*f* and allow the holder to move downwardly, guided in guide slots 20, until pins snap through neck areas 40*e* and fuse 14 is in its inserted and operative position.

The invention fuse holder is compatible with an automated fuse box assembly process in which the fuse need not be inserted into the holder prior to assembly with the fuse box. In such a process, fuses 14 of appropriate amperage rating are insert ed as a group into connected positions in each fuse receptacle 18*a–d* prior to the fuse holder being mounted to the fuse box. Fuse holder 10, with cover 36 closed and latched, is then positioned over fuse receptacle 18*d* such that mounting legs project toward and are aligned with guide slots 20, and the fuse holder is mounted to the fuse box by urging it downward to slide the mounting legs 26 into the guide slots 20 and bring the lower side of frame 24 into contact with the top end of fuse 14. As fuse 14 starts to pass through opening 30, the top end of the fuse contacts ramp surfaces 32*a* of retaining nubs 32. The inward taper of the ramp surfaces allows the fuse to slide therealong and, as seen in FIG. 6, the interference between the ramp surfaces and the fuse deflects frame 24 outwardly slightly as the fuse passes through opening 30. When the top end of fuse 14 moves past retaining nubs 32, the nubs snap into their respective channels 14*c* as frame 24 returns to its undeflected position, and the physical interference between end walls 14*d* of the channels and stop surfaces 32*b* of the nubs serves to prevent the fuse from moving back out of the frame. Since closed cover 36 prevents fuse 14 from moving any further through opening 30, the fuse is securely retained in a fixed position within the holder.

As holder 10 moves downwardly over fuse 14, mounting legs 26 likewise move downwardly into guide slots 20 such that bevelled ends 26*a* of mounting legs 26 come into contact with the upper sides of pins 22. As the downward urging of the holder continues, the interfering contact between bevelled ends 26*a* and pins 22 causes the legs to flex outwardly until circular portions 40*a* of slots 40 come into alignment with the pins. At this point legs 26 snap back inwardly and pins 22 are retained in the slots, continued downward movement of holder 10 forcing the pins through neck areas 40*f* and 40*e* in sequence and finally into slot oval portions 40*b*, at which point the holder is fully inserted into the fuse box.

At times, a fuse 14 retained in fuse holder 10 will require removal and replacement. This is accomplished by first pulling holder 10 upwardly to the pre-set position, then opening cover 36 by pulling outwardly on latch wall 36*c* to disengage latch apertures 36*d* from latch projections 34 and then lifting upwardly on the cover. Once cover 36 is open, fuse 14 may be easily lifted out of its position within opening 30, a replacement fuse inserted, the cover snapped back closed, and the fuse holder returned to the inserted position.

The invention fuse holder will be seen to provide a simple, effective means whereby those fuses which must be moved to an inoperative position during a period of non-use or maintenance of the associated electrical system may be securely retained in a captive, pre-set position during the period, and to allow the use of an automated procedure in assembling a fuse box having the desired captive fuse feature.

Whereas a preferred embodiment of the invention has been illustrated and described in detail, it will be apparent that various changes may be made in the disclosed embodiment without departing from the scope or spirit of the invention.

We claim:

1. A fuse holder for mounting a fuse in captive association with a fuse box having at least one fuse receptacle for receiving a fuse of the type having a body and two parallel bayonet-type connectors extending therefrom, the fuse holder comprising a frame defining a hollow interior volume with an open upper side through which the fuse may be inserted to position the fuse body in an essentially fixed position within the interior of the frame and an open lower side which permits the connectors to extend therethrough and be exposed below the frame, and mounting legs extending from the frame at opposite ends thereof for engagement with the fuse box, the fuse holder characterized in that:

grip tabs extend from the frame at opposite ends thereof in a direction substantially opposite from the mounting legs; and a cover is connected to the frame and is movable into and out of a position closing the upper side of the interior of the frame, the cover disposed between the grip tabs when moved into said position.

2. A fuse holder according to claim 1 wherein the cover is connected to the frame by a living hinge.

3. A fuse holder according to claim 1 further comprising cooperating latch means disposed on the cover and on the frame for securing the cover in the closed position.

4. A fuse holder according to claim 1 further comprising a window in the cover for allowing viewing of the fuse when the fuse is in the essentially fixed position within the frame and the cover is in the closed position.

5. A fuse holder according to claim 1 wherein at least one of the mounting legs has a slot formed therein for engagement with a pin disposed on the fuse box.

6. A fuse holder according to claim 5 wherein the slot comprises:

a substantially oval portion adjacent a first end of the leg adjacent the frame and having a width greater than the diameter of the pin;

a substantially circular portion adjacent a second end of the leg distal from the frame and having a diameter greater than the diameter of the pin; and a central portion having a first end contiguous with the oval portion and a second end contiguous with the circular portion and a middle disposed therebetween, the central portion having a width at the middle greater than the diameter of the pin and decreasing in width at the first and second ends to form respective first and second neck areas having widths smaller than the diameter of the pin.

7. A fuse holder for mounting a fuse in captive association with a fuse box having at least one fuse receptacle for receiving a fuse of the type having a body and two parallel bayonet-type connectors extending therefrom, said fuse holder comprising a frame defining a hollow interior volume, an open upper side through which the fuse may be inserted to position the fuse body in an essentially fixed position within the interior of the frame and an open lower side which permits the connectors to extend therethrough and be exposed below the frame, the fuse holder characterized in that:

at least one retainer nub extends from the frame into the interior of the frame, the retainer nub having a ramp surface inclined with respect to an axis between the upper and lower sides of the frame to allow the fuse to pass into the fixed position from the lower side of the frame and a stop surface substantially perpendicular to the axis for engaging a cooperating surface on the fuse when the fuse is in the fixed position to substantially prevent movement of the fuse out of the fixed position through the lower side of the frame.

8. A fuse holder according to claim 7 wherein the fuse holder is intended for use with fuses having a main body with first and second parallel sides and a pair of channels formed in each of first and second sides of the body, and wherein four retainer nubs extend into the opening to engage each of the four channels.

9. A fuse holder for maintaining a fuse in movable connection with a fuse block, the fuse of the type having a body with first and second sides and channels formed in the first and second sides forming stop surfaces adjacent an upper end of the fuse, the fuse holder comprising:

a frame having inner surfaces defining a hollow interior volume with an open upper side and an open lower side, the frame adapted to encircle the fuse body and hold the fuse in an essentially fixed position with respect to the fuse holder;

a plurality of retaining nubs disposed on the frame and projecting into the interior volume, the retaining nubs having ramp surfaces inclined with respect to the inner surfaces of the frame to permit movement of the fuse into the fixed position through the lower side of the frame and end surfaces oriented substantially perpendicular to the inner surfaces of the frame for engaging the stop surfaces of the fuse to block movement of the fuse from the fixed position through the lower side of the frame;

a pair of parallel mounting legs extending from the first side of the frame, the mounting legs having means for engaging the fuse block to retain the fuse holder in movable connection therewith; and a cover connected to the frame and movable between a closed position wherein the cover at least partially blocks the upper side of the frame to block movement of the fuse away from the fixed position toward the upper side, and an open position wherein the cover does not significantly block movement of the fuse.

10. An automotive fuse box assembly comprising:

a fuse box having a plurality of fuse receptacles for receiving in electrical association therewith respective fuses having bayonet-type connectors;

a fuse holder having a frame with inner surfaces defining a hollow interior volume with an open upper side and an open lower side, the frame adapted to encircle the fuse body and hold the fuse in an essentially fixed position relative to the fuse holder, a plurality of retaining nubs disposed on the frame and projecting into the interior volume, the retaining nubs having ramp surfaces inclined with respect to the inner surfaces of the frame to permit movement of the fuse into the fixed position through the lower side of the frame and end surfaces substantially perpendicular to the inner surfaces of the frame for engaging the fuse to block movement of the fuse from the fixed position through the lower side of the frame;

a cover connected to the frame and movable between a closed position wherein the cover at least partially blocks the upper side of the frame to block movement of the fuse away from the fixed position toward the upper side, and an open position wherein the cover does not significantly block movement of the fuse; and means for mounting the fuse holder on the fuse box for displacement relative thereto between a first position wherein the fuses are retained in the respective fuse receptacles and a second position wherein the fuses are disconnected from the respective fuse receptacles.

11. A fuse holder for mounting a fuse in captive association with a fuse box having at least one fuse receptacle for receiving a fuse of the type having a body and two parallel bayonet-type connectors extending therefrom, the fuse holder comprising a frame defining a hollow interior volume with an open upper side through which the fuse may be inserted to position the fuse body in an essentially fixed position within the interior of the frame and an open lower side which permits the connectors to extend therethrough and be exposed below the frame, and first and second mounting legs extending downwardly from the frame at opposite ends thereof for engagement with the fuse box, at least one of the mounting legs having a slot formed therein for engagement with a pin disposed on the fuse box, the slot comprising:

a substantially oval portion adjacent a first end of the leg adjacent the frame and having a width greater than the diameter of the pin;

a substantially circular portion adjacent a second end of the leg distal from the frame and having a diameter greater than the diameter of the pin; and a central portion having a first end contiguous with the oval portion and a second end contiguous with the circular portion and a middle disposed therebetween, the central portion having a width at the middle greater than the diameter of the pin and decreasing in width at the first and second ends to form respective first and second neck areas having widths smaller than the diameter of the pin.

* * * * *

UNITED STATES PATENT AND TRADEMARK OFFICE

CERTIFICATE OF CORRECTION

PATENT NO. : 5,816,858

DATED : October 6, 1998

INVENTOR(S) : David Kazarian

It is certified that error appears in the above-indentified patent and that said Letters Patent is hereby corrected as shown below:

Column 3, Line 63, delete "older" and insert --holder--.

Column 3, Line 65, delete "use" and insert --fuse--.

Column 4, Line 59, delete "tubs" and insert --nubs--.

Column 4, Line 60, delete "an d" and insert --and--.

Column 5, Line 43, delete "25" and insert -- 2-5 --.

Column 6, Line 18, delete "insert ed" and insert --inserted--.

UNITED STATES PATENT AND TRADEMARK OFFICE

CERTIFICATE OF CORRECTION

PATENT NO. : 5,816,858

DATED : October 6, 1998

INVENTOR(S) : David Kazarian

It is certified that error appears in the above-indentified patent and that said Letters Patent is hereby corrected as shown below:

Delete Drawing Sheet 2 of 2, and substitute the Drawing Sheet, consisting of FIGS. 4-7, as shown on the attached page.

Signed and Sealed this

Twenty-seventh Day of April, 1999

*Attest:*

Q. TODD DICKINSON

*Attesting Officer*

*Acting Commissioner of Patents and Trademarks*